United States Patent [19]

Worni

[11] 4,443,287

[45] Apr. 17, 1984

[54] METHOD OF MANIPULATING PRINTED PRODUCTS AND MEANS AND APPARATUS FOR PERFORMANCE THEREOF

[75] Inventor: Guido Worni, Hinwil, Switzerland

[73] Assignee: Ferag AG, Hinwil, Switzerland

[21] Appl. No.: 248,238

[22] Filed: Mar. 27, 1981

[30] Foreign Application Priority Data

Apr. 10, 1980 [CH] Switzerland ..... 2743/80

[51] Int. Cl.[3] ..... B32B 31/00; B32B 31/12; B32B 31/26

[52] U.S. Cl. ..... 156/247; 156/65; 156/67; 156/277; 156/290; 156/297; 156/344; 271/202; 493/382

[58] Field of Search ..... 156/247, 344, 249, 277, 156/290, 67, 292, 297, 302, 65; 271/33, 202, 203, 216; 414/904; 198/461, 462; 221/73; 493/347, 382

[56] References Cited

U.S. PATENT DOCUMENTS 3,645,823 2/1972 Merk et al. ..... 156/247

4,108,702 8/1978 Welch et al. ..... 156/297 X

*Primary Examiner*—William A. Powell

*Assistant Examiner*—Thomas Bokan

*Attorney, Agent, or Firm*—Werner W. Kleeman

[57] ABSTRACT

With the aid of a traction element at which there are temporarily fixed or attached the printed products, such as newspapers, periodicals and the like, there is rendered possible maintaining a certain order of the printed products during their processing, while however affording the possibility of altering the product order or arrangement, and thereafter to again reestablish the same. The traction element possesses a latent adhesion or sticking capability which can be activated in order to fix the products at the traction element. It is conversely possible to annihilate the adhesion or sticking capability or property and thus to detach the traction element from the products without damage to the products or leaving any visible marks or traces thereat. It is preferred to use a traction element which is provided with a hot melt, and the fixation of the products at the traction element and the detachment of the traction element from the products is accomplished in the presence of heat.

4 Claims, 2 Drawing Figures

Fig. 1
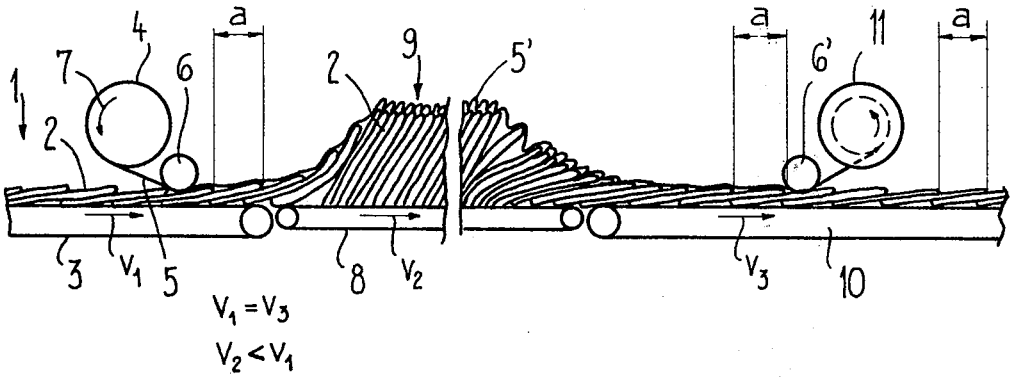
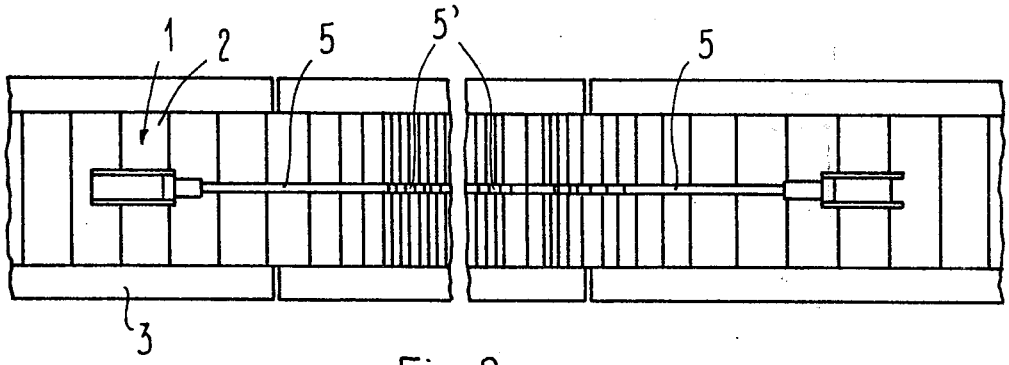
Fig. 2

METHOD OF MANIPULATING PRINTED PRODUCTS AND MEANS AND APPARATUS FOR PERFORMANCE THEREOF

BACKGROUND OF THE INVENTION

The present invention relates to a new and improved method of manipulating printed products and further pertains to means and apparatus for the performance of the aforesaid method.

During the processing of printed products, such as typically newspapers and periodicals, frequently such assume a predetermined orderly formation or arrangement. Yet, the arrangement of the product formation can be endangered by external effects or the product formation can temporarily be annihilated, later however must again be reestablished. In any event there is present the problem that the position of the products as such and in relation to one another must be defined or fixed, so that their momentary formation is comparable in precision for instance to a machine part or a fixedly joined together system, so that there can be ensured proper access to the products and, in particular, their automatic further processing, without it being necessary to detect the individual products. These conditions, as stated, should be maintained or capable of being reestablished following a temporary elimination of the defined product order or arrangement, without it being necessary to engage or manipulate the individual products.

SUMMARY OF THE INVENTION

Therefore, with the foregoing in mind it is a primary object of the present invention to provide a method of manipulating printed products as well as means and apparatus for the performance thereof, which enables fulfilling these requirements in a most simple, positive and reliable fashion.

Another and more specific object of the present invention aims at defining the handled products in relation to their relative position in a predetermined formation or arrangement, wherein however the product order need not be fixedly maintained at all times, so that the products can assume one or a number of other relative positions and thus also form other product formations, with however there being afforded the possibility of reestablishing the originally defined product formation.

A further significant object of the present invention aims at a method of manipulating products and means for performing the aforesaid method, wherein the products can be handled while momentarily fixed in a predetermined product order or formation, this product formation can be altered as desired and again reestablished in a most simple manner.

Now in order to implement these and still further objects of the invention, which will become more readily apparent as the description proceeds, the inventive method contemplates fixing the products in a defined formation, for instance in an imbricated formation or in successive spaced relationship from one another and so forth, at a flexible traction element possessing a latent adhesion or sticking property by activating such property. Following a last or predetermined working operation the traction element can be detached from the products by neutralizing the adhesion or sticking property of the traction element. This traction element renders possible maintaining the defined position or order of the products or reestablishing the same in that it can be maintained in a tensioned state or can be brought into such tensioned condition, and conversely the flexibility of the traction element enables bringing the products into a predetermined different order or formation. In the context of this disclosure the term "adhesion property" or "adhesion capability" as used hereinafter is intended to refer broadly to adhesion, adherence, sticking, binding or similar fixation properties of the flexible traction element or equivalent structure.

The traction element for the performance of the method, as contemplated by the invention, is provided with a heat sealable material, commonly referred to in the art as a hot melt, typically hot-melt thermoplastic adhesives. In the context of this disclosure there are meant those materials which product a connection or bond between the traction element and the products when the traction element, under the application of heat, is pressed against the products and thereafter the adhesive or adherable material cools, and conversely through the application of heat the traction element again can be detached from the products without such being damaged or that there are formed thereat marks or traces of the material having the adhesion property or capability.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 schematically illustrates a side view of an apparatus for practicing the method; and FIG. 2 is a top plan view of the apparatus shown in FIG. 1.

DETAILED DESCRIPTION OF THE PREFERRED EMBODIMENTS

Describing now the drawings, the exemplary embodiment of apparatus shown in FIGS. 1 and 2, useful for the practice of the method of the present development, renders it possible to fix printed products arriving in an imbricated product stream at the traction element, damming-up the imbricated product stream or formation in order, for instance, to form an intermediate storage, and thereafter again forming an imbricated product formation possessing the original spacing between the overlapping or overlying products of the imbricated product formation. Such type of equipment could be used, for instance, when it is necessary to temporarily slow down the imbricated product stream in order to be able to accommodate the system to fluctuations during manipulation or handling of the incoming printed products, irrespective of the reason that such fluctuations have arisen.

Turning attention now specifically to FIGS. 1 and 2, the imbricated product formation or stream 1 composed of overlapping newspapers 2 by way of example, is infed by means of a conveyor band or belt 3 at a velocity $V_1$, and the so-called imbrication spacing, i.e. the overlap between two neighboring products amounts to a. Above the conveyor belt 3 there is located a supply roll 4 for a supporting element in the form of a traction element 5 and, following the indicated conveying or feed direction, a heating roll 6. Any suitable drive means serve to drive the supply roll 4 and the heating roll 6 in the direction indicated by the arrow 7. The traction element 5, for instance in the form of a thin band or tape, for example formed of a suitable plastic material, is provided at its outer side, in relation to the supply roll 4, i.e. the side confronting the imbricated product formation 1 with a material, typically a hot melt, which under the action of heat softens. The thickness of this material, possessing the mentioned adhesion property or capability, amounts to approximately 10 microns. In order to be better able to detect a single-face application of the coated side of the traction element 5 it is possible to admix to the material a fluorescent dye or marking color which then can be readily discerned beneath a lamp or other suitable detection device. Of course, this material could be applied to both sides of the band from which there is formed the traction element 5, or it would be possible to imbue such band with such type material.

The traction element 5 is guided below the heating roll 6, is then heated by such heating roll 6 and immediately pressed against the leading edge of the printed products 2, so that upon cooling of the applied coating material the traction element 5 adheres to the contacted printed products 2, and conversely the printed products, in the present case assumed to be newspapers, are fixed at the traction element 5. Immediately thereafter the imbricated product stream or formation 1 arrives at a further conveyor belt or band 8, whose velocity $V_2$ is smaller than the velocity $V_1$ of the preceding or upstream arranged conveyor belt 3. Consequently, there is formed a dammed-up imbricated stream in the configuration of a stack 9 composed of the inclined arranged newspapers 2. At the region of the conveyor belt or band 8 there is thus located the actual dam-up or temporary storage space.

Following downstream of the conveyor belt 8 is a further conveyor belt or band 10, the velocity $V_3$ of which is equal to the velocity $V_1$ of the first or infeed conveyor belt or band 3. At the region of the conveyor band 10 the dam-up of the products is annihilated. In this respect it is of appreciable importance that the traction element 5 which forms a loop-shaped or undulated traction element, as indicated by reference character 5' at the product dam-up region defined by the conveyor belt 8, is withdrawn by a take-up roll 11 driven in the counterclockwise direction. The traction element 5 then travels below a further heating roll 6' where it is heated-up, so that there are established the prerequisites for ensuring that immediately thereafter the traction element 5 can be detached from the newspapers 2 without damaging the latter or leaving any visible marks or traces at the products evidencing their prior connection with the traction element 5. The imbricated spacing a is again established, and thus, following the temporary damming-up or stowing of the products there is reestablished the original imbricated product formation.

Basically it would be possible to repeatedly use the traction element 5. On the other hand, this traction element 5, particularly if it is structured as a thin plastic tape or band, can be produced so inexpensively that it is not absolutely necessary to repeatedly use the same. This is particularly so because in the case of a so-called "throwaway traction element" the plastic material itself can be readily processed and reused.

In the broader sense the traction element 5 constitutes a transport means, particularly then when there should be reestablished the original product formation. In fact this is accomplished exactly by virtue of the fact that upon extension of the traction element the printed products are forced to assume their original relative position. Nothing changes even if—as is the case with the illustrated exemplary embodiment—there are employed still further transporting devices, such as the conveyor belts or bands, yet the primary task of the traction element is not in the actual further conveying of the products but in maintaining the original relative position or the reestablishment thereof. The movement of the products need not necessarily be accomplished solely by the traction element, rather such could be incorporated or integrated into a transport system.

This will be readily understood based upon a further example which will be discussed hereinafter, by way of illustration and not limitation. It would be possible, for instance, to form from the products arriving in an imbricated formation rather voluminous upright or reposing stacks and deposit such in an intermediate storage. During stack stripping, i.e. removing single product copies out of the stack it is possible to again reestablish the original imbricated formation. On the other hand, it is however possible to infeed the products directly for the automatic further processing thereof, or to otherwise have them experience some manipulation or handling. In any event these products, by virtue of the action of the traction element, appear at a defined spacing from one another and within the work cycle at predetermined points in time and are so accessible, without it being necessary to previously individually detect and engage the products.

Of course, the imbricated product formation is not an absolutely required starting formation. The products could also arrive individually or in rows in spaced relationship. In such case there can be accomplished between the traction element and the products a relatively long overlying configuration, and it is not necessary to accomplish the fixation of the products throughout the entire length of the contact zone. One or a number of locations provided in spaced relationship are sufficient, depending upon which manipulations should be carried out at the printed products or the like. In particular applications it is also possible to use two mutually parallel traction elements, for instance if—by the way of example in the case of an imbricated formation—it is intended to not only ensure for the imbricated spacing but also the parallel position of the products.

While there are shown and described present preferred embodiments of the invention, it is to be distinctly understood that the invention is not limited thereto, but may be otherwise variously embodied and practiced within the scope of the following claims. Accordingly,

What is claimed is:

1. A method of manipulating sheet-like products, especially printed products, specially newspapers and periodicals, comprising the steps of:

fixing the products in a single operating step in a defined formation at a flexible traction element provided with a heat sealable material having a latent adhesion property by activating said adhesion property by applying heat;

altering the defined formation of the products during manipulation thereof while maintaining a given order of the products; and then detaching the traction element from the products by neutralizing its adhesion property by the application of heat.

2. The method as defined in claim 1, further including the steps of:

infeeding the products in an imbricated stream which constitutes said defined formation.

3. The method as defined in claim 1, further including the steps of:

infeeding the products in succession in spaced relationship from one another.

4. The method as defined in claim 1, wherein:

the step of altering the defined formation of the products during manipulation thereof encompasses changing the relative position of at least predetermined ones of said products within the defined formation while maintaining said given order of said products.

* * * * *